US006829876B1

(12) United States Patent
Young et al.

(10) Patent No.: US 6,829,876 B1
(45) Date of Patent: Dec. 14, 2004

(54) PROCESS FOR SPLICING A CONTINUOUS STRIP OF PACKETS

(76) Inventors: Robert W. Young, 103 Goulet Ct., Belen, NM (US) 87002; Tateshi Kimura, 14612 Golden Leaf Pl., Louisville, KY (US) 40245; Stefan O. Dick, 8204 William Moyers Ave., NE., Albuquerque, NM (US) 87122

( * ) Notice: Subject to any disclaimer, the term of this patent is extended or adjusted under 35 U.S.C. 154(b) by 0 days.

(21) Appl. No.: 10/068,342

(22) Filed: Feb. 5, 2002

(51) Int. Cl.[7] ..... B65B 9/00

(52) U.S. Cl. ..... 53/450; 53/410; 53/416; 53/548; 53/550

(58) Field of Search ..... 53/450, 410, 416, 53/548, 550, 553; 156/73.1, 73.4, 157, 158, 159

(56) References Cited

U.S. PATENT DOCUMENTS

| | | | | |
|---|---|---|---|---|
| 2,182,169 A | | 12/1939 | Bierer | |
| 2,500,273 A | | 3/1950 | Breth | |
| 2,702,070 A | | 2/1955 | Lindemann | |
| 3,189,227 A | | 6/1965 | Hobbs et al. | |
| 3,254,828 A | | 6/1966 | Lerner | |
| 3,556,912 A | | 1/1971 | Burgo et al. | |
| 3,661,667 A | * | 5/1972 | Gardner et al. | 156/73.4 |
| 3,751,875 A | | 8/1973 | Membrino | |
| 4,047,992 A | * | 9/1977 | Williams et al. | 156/73.1 |
| 4,467,207 A | | 8/1984 | Lerner et al. | |
| 4,467,589 A | | 8/1984 | van Maanen | |
| 4,490,199 A | * | 12/1984 | Dunning | 156/73.4 |
| 4,534,818 A | * | 8/1985 | Kreager et al. | 156/466 |
| 4,680,205 A | | 7/1987 | Lerner et al. | |
| 4,743,333 A | * | 5/1988 | Forthmann | 156/359 |
| 4,744,845 A | * | 5/1988 | Posey | 156/159 |
| 4,752,002 A | | 6/1988 | Takahashi et al. | |
| 4,844,956 A | | 7/1989 | Galimberti | |
| 4,859,270 A | | 8/1989 | Martin et al. | |
| 4,907,393 A | | 3/1990 | Omori et al. | |
| 4,957,521 A | | 9/1990 | Cullen et al. | |
| 5,064,488 A | | 11/1991 | Dickey | |
| 5,157,902 A | | 10/1992 | Hatakeyama | |
| 5,253,819 A | | 10/1993 | Butler, Jr. | |
| 5,284,197 A | | 2/1994 | Cederholm et al. | |
| 5,360,502 A | | 11/1994 | Andersson | |
| 5,464,488 A | * | 11/1995 | Servin | 156/73.4 |
| 5,468,321 A | | 11/1995 | van Liempt et al. | |
| 5,632,831 A | * | 5/1997 | Stull | 156/73.3 |
| 5,887,722 A | | 3/1999 | Albrecht et al. | |
| 6,076,671 A | | 6/2000 | Malecki et al. | |
| 6,086,806 A | | 7/2000 | Weatherall et al. | |
| 6,228,205 B1 | | 5/2001 | Rhodes et al. | |
| 6,264,130 B1 | | 7/2001 | Hartley, Jr. | |
| 6,342,118 B1 | * | 1/2002 | Ward | 156/159 |

FOREIGN PATENT DOCUMENTS

| | | |
|---|---|---|
| EP | 0490398 | 6/1992 |
| EP | 0829754 | 3/1998 |
| JP | 9099974 | 4/1997 |
| WO | WO 9959907 | 11/1999 |

* cited by examiner

*Primary Examiner*—Rinaldi I. Rada
*Assistant Examiner*—Hemant M. Desai

(57) ABSTRACT

A process for splicing cut ends of a continuous strip of packets or bags used to hold bulk material. The steps of the process include forming a continuous strip of packets from packaging material and filling the packets with bulk material. The edges of the packaging material are sealed to form individual packets of the continuous strip such that adjacent packets share a common sealed area of packaging material. Openings are then formed in the common sealed areas between the adjacent packets. The continuous strip is then cut entirely across the common sealed area of the packets at two separate locations on the continuous strip to form cut ends such that each of the cut ends of the continuous strip contains an opening in the common sealed area. Without using splicing tape, the two cut ends of the continuous strip with openings are spliced together such that the openings in the two cut ends overlap. The splicing process can be accomplished by ultrasonic welding, impulse splicing or other processes. Also disclosed is equipment for the splicing processes.

7 Claims, 4 Drawing Sheets

PROCESS FOR SPLICING A CONTINUOUS STRIP OF PACKETS

CROSS REFERENCE TO RELATED APPLICATIONS

NONE

BACKGROUND OF THE INVENTION

1. Field of Invention

This invention relates to processes for splicing the cut ends of a continuous strip of packets used to hold granular bulk material. More particularly, the invention relates to processes for splicing the cut ends of a continuous strip of packets utilizing heat or ultrasonic energy and splicing devices used for those processes.

2. Description of Related Art

Continuous strips of material or webs are manufactured for many uses. One such use is for the manufacture of continuous strips of packets or bags containing bulk materials such as desiccants or deodorizers. For example, a continuous strip of packets of a deoxidizing agent are disclosed in U.S. Pat. No. 4,752,002. In use, one or more of the individual packets of this product are severed from the continuous strip and placed with or in a container to deoxidize the air associated therewith or contained therein.

Another continuous strip of packets containing bulk material is disclosed in U.S. Pat. No. 4,957,521, wherein the packets are formed from a heat fusible material. The strip of packets contains perforations between each individual packet which perforations can be used to trigger an automatic cutting machine to sever the packet from the strip. The packets of this strip preferably contain a desiccant material.

U.S. Pat. No. 3,189,227 discloses a continuous strip of packets, each of which contain a single dosage of a drug or ointment. Other continuous strips of packets of products are disclosed in, for example, U.S. Pat. Nos. 3,751,875, 3,254,828, 4,467,207, 4,680,205, 4,844,956, 4,907,393, 5,157,902 and 5,887,722.

The types of products that are conventionally loaded into these packets or bags include desiccants, odor absorbers, oxygen absorbers and the like. Many of these packets or bags are formed from packaging materials which allow air to flow through the packaging material to permit the desiccant or absorber contained therein to remove certain material (s) from the air, such as water, oxygen or odors.

Form-fill-and-seal machines are commonly used to produce these continuous strips of packets. Conventionally, these machines form a packet by a process of sealing the continuous length of material to itself, filling packets formed by that sealing process with a bulk material and finally, sealing the remaining open end of the packets. Different technologies can be used to form the seals on these packets, depending on the type and composition of the packaging material and the method of formation of the packets. Pressure, heat or some form of sealing energy is applied to the packaging material, such as by means of heated seal bars, impulse sealers or ultrasonic heater to create the seals. Usually these packets have three seal areas where the packaging material that is used to produce the packets is sealed to itself: two end seals and one edge seal on the back of the packet. After formation and filling with the bulk material, the packets are generally used either as single packets or in the form of a continuous strip that is wound onto a reel or fan-folded into a box for storage and shipping.

During the manufacture of these packets, there are frequently situations when the form-fill-and-seal machine must be stopped during a production run due to mechanical or electrical problems, scheduled maintenance or adjustments to the packets. In addition, for quality control and for other reasons, the packets from the continuous strip must often be sampled.

In order to insure that the specified minimum number of packets are present on the continuous strip, on a reel or in a packaging box for the packets, there are often situations when two ends of the continuous strip must be spliced together. Further, if a sample must be removed from the continuous strip, the loose ends of the continuous strip which are produced by the sampling process must be spliced together to reform the continuous strip. In addition, if a problem occurs during processing of the continuous strip which results in damage to one or more packets, it is necessary to cut out the damaged packet(s) from the continuous strip necessitating the splicing of the two remaining ends of the continuous strip.

The traditional preferred method to splice two ends of a continuous strip of packets together is to use a section of adhesive tape to connect the two loose ends. In fact, some consumers of these packets require use of a colored piece of adhesive tape to splice the loose ends of a continuous strip together to indicate where the splice exists in the continuous strip.

The use of tape to seal continuous strips of material is disclosed, for example, in U.S. Pat. Nos. 4,859,270 and 6,076,671. A process for splicing a continuous web of paper using an adhesive tape is disclosed in U.S. Pat. No. 6,228,205. Splicing continuous webs of material with an adhesive is also disclosed in U.S. Pat. Nos. 6,264,130 and 5,253,819. Other splicing processes are disclosed in U.S. Pat. Nos. 5,468,321 and 6,086,806.

The process of splicing the ends of other compositions of material is also well known. However, the splicing of these materials is not relevant to the splicing of a continuous packaging material for a number of reasons, including the significant differences in the composition of the materials used to form the continuous strip. As an example of the splicing of these dissimilar products, photographic film is often spliced, as disclosed in U.S. Pat. No. 3,556,912 and 5,064,488. The splicing of a soft paper web material is disclosed in U.S. Pat. No. 5,360,502 and the splicing of endless rubber belts is disclosed in U.S. Pat. Nos. 2,182,169, 2,500,273 and 2,702,070. An apparatus for preparing and positioning a continuous roll of material which contains a recurring pattern for splicing is disclosed in U.S. Pat. No. 5,284,197. However, this patent does not disclose the method of splicing the two ends of the material together.

As stated above, the conventional preferred method for splicing loose ends of a continuous strip of packets containing bulk material, such as desiccants, is by using an adhesive tape. These packets, especially desiccant packets, are widely used in the pharmaceutical, nutritional and diagnostic industry. The packets are packaged with the finished goods to provide moisture control and avoid moisture induced degradation of the packaged products.

Modern packaging facilities for pharmaceutical, nutritional and diagnostic products run at high speed and require a reliable and fast method of insertion of these individual packets into the packaging for these products, which packaging may be in the form of a bottle, vial or box. The most common method to dispense these packets into the packaging is by use of a machine that cuts the continuous strip of desiccant packets and dispenses the cut individual packets into the packaging. To assure a reliable cutting and dispensing process, the dispensing machine needs a method to sense where the individual packets of the continuous strip begin and end. Some methods for sensing can, for example, measure the length of the packets or the thickness of the packets. (The portion of the packets containing the bulk material is thicker than the seal area separating the packets.) These methods of sensing have disadvantages because the sensor can be confused by the variability of the packet length or fill volume. This confusion can result in a packet being cut in the portion of the packet containing the fill material instead of at the seal area between two individual packets. This type of cutting error results in down time for the packaging line, spill of the bulk material and potential contamination of the product being packaged.

The most advanced method to solve this sensing problem utilizes a continuous strip of bulk material containing punch holes in the seal area between the individual packets as shown, for example, in U.S. Pat. No. 4,957,521 and Japanese Patent No. 9,099,974. This punch hole is then sensed by a light sensor at the dispensing unit. The sensor senses where the seal area between the packets is located and cuts the packet at that location. The light sensor senses this location by sensing differences in light transmission through the packets and through the holes between the individual packets. This difference is so large that this light sensor generally only needs minimal adjustment during processing and is very reliable.

Notwithstanding the advances in the processes for accurately cutting individual packets of bulk material, it is almost unavoidable that continuous strips will contain splices between some of the individual packets. As stated above, the conventional preferred method for splicing the ends of a continuous strip that is accepted in the industry is by taping the cut ends using a colored piece of tape. However, the presence of even a few such taped splices can be detrimental. In fact, oftentimes the consumer of these continuous strips demands that the continuous strip contain no more than a small number of such taped splices. If too many taped splices are present, the entire continuous strip may be rejected. Further, there are often significant problems when adhesive tape is used to form these splices. For example, conventional adhesive tape is not as strong as the original uncut packaging material used in the continuous strip. The use of adhesive tape also requires stopping the packet dispensing machines to remove the spliced tape. Further, the tape material does not have the same physical characteristics as the material that forms the packet, such as permeability. In addition, a taped packet is not as visually appealing to a consumer as a non-taped packet. Finally, the adhesive tape sometimes jams the dispensing machine and does not have as long a life expectancy as that of an untaped seal.

Accordingly, it is an object of this invention to develop a method for splicing continuous strips of packaging material which solves these problems.

It is also an object of the invention to provide a method to splice the cut ends of a continuous strip of packets or bags which hold bulk material.

It is a further object of the invention to disclose a process for splicing the cut ends of a continuous strip of packets or bags holding bulk material, which does not utilize tape to seal the cut ends.

It is a still further object of the invention to disclose a process for splicing the cut ends of a continuous strip of packets or bags used to hold bulk materials which utilizes ultrasonic welding as the splicing method.

It is a still further object of the invention to disclose a process for splicing the cut ends of a continuous strip of packets or bags used to hold bulk material, whereby the two ends are heated and melted or partially melted together.

It is a still further object of the invention to disclose a process for the splicing of the cut ends of a continuous strip of packets or bags used to hold bulk materials, wherein the two cut ends are joined by use of an adhesive material.

These and further objects of the invention are obtained by the processes for production and products used with these processes of the invention disclosed herein.

SUMMARY OF THE INVENTION

The present invention is a process for splicing cut ends of a continuous strip of packets or bags used to hold bulk material comprising forming a continuous strip of packets from packaging material and filling the packets with the bulk material, sealing the ends of the packaging material to form individual packets of the continuous strip, wherein the individual packets share a common sealed area of packaging material, forming an opening in the common sealed area between adjacent packets, cutting the continuous strip entirely across the sealed area of the packets at two separate locations on the continuous strip, wherein each of two remaining cut ends of the continuous strip comprise a sealed section with an opening in that sealed section, and, without using tape, splicing together the two sealed sections of the continuous strip such that the openings in the cut ends of the sealed sections overlap leaving a single opening in the spliced section of the continuous strip.

In one preferred embodiment the two sealed sections are spliced together by use of ultrasonic welding.

In another preferred embodiment the two sealed sections are spliced by heating to melt or partially melt the sealed sections of the continuous strip together.

In a further preferred embodiment, the two sealed sections are spliced together by use of an adhesive.

The invention further encompasses an impulse splicing device useful for splicing a pair of ends of a continuous strip of packets used to hold bulk materials wherein each of the ends of the continuous strip includes an opening in a sealed section, wherein the device comprises a pair of connected arms, each containing a base, wherein one of the bases on one of the arms comprises a lower surface element, a pin secured to the lower surface element and guiding sides secured to the lower surface area, wherein the second base comprises an upper surface element with an opening therein, which upper surface area is secured to the second arm, and wherein the device further comprises an energy supply mechanism connected to the pair of arms to supply energy for melting or partially melting the ends of the continuous strip of packets when the ends are placed between the two bases, the two bases are pressed together and the energy supplying mechanism supplies energy to the bases.

In a further preferred embodiment the invention further comprises an ultrasonic welding tool useful for the splicing of a pair of ends of a continuous strip of packets used to hold bulk materials wherein each of the ends of the continuous strip includes an opening in a sealed section, wherein the device comprises an anvil element comprising a base to which is secured a pin and guiding sides and an ultrasonic energy generator element comprising a hand piece, a horn secured to an end of the hand piece, wherein the horn comprises a resonator element and an opening at one end of the horn, and a power supply to supply energy to the horn.

The invention further comprises a spliced continuous strip of packets or bags used to hold bulk material formed by the processes described above.

DRAWINGS

Figure 5:
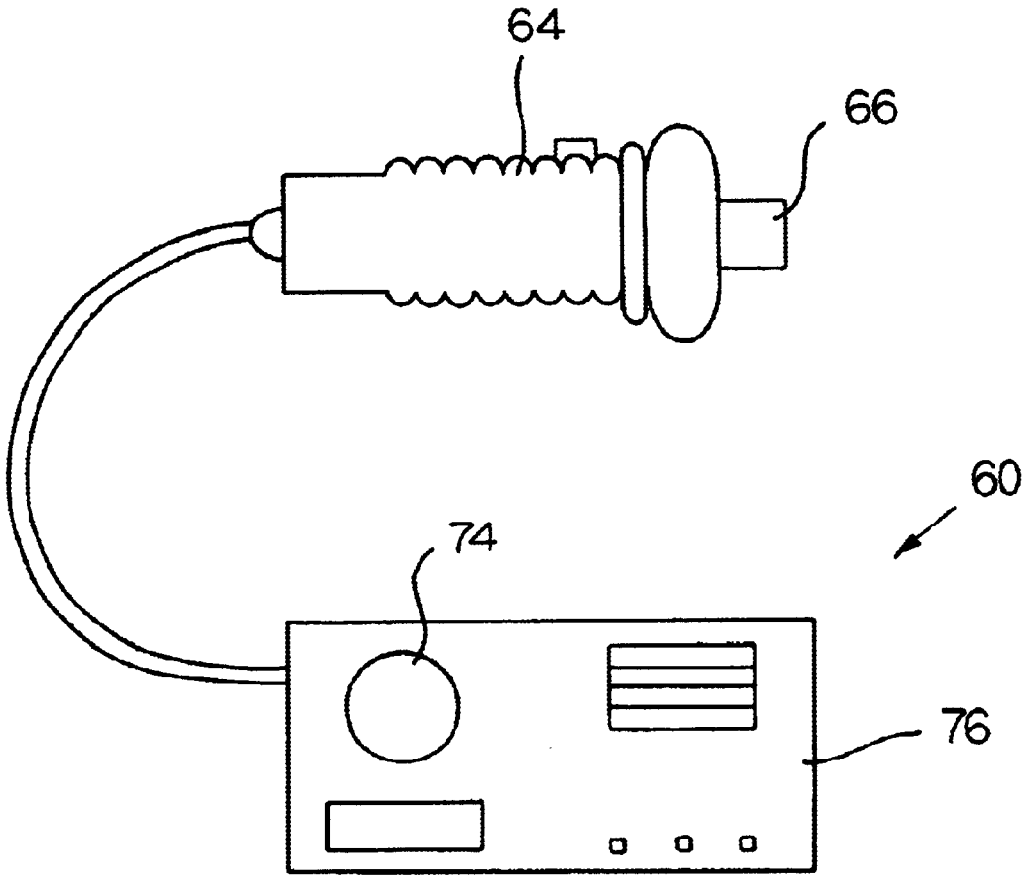
FIG. 5 is an ultrasonic splicing device for splicing the sealed areas of two cut end sections of a continuous strip of packets.
Figure 6A:
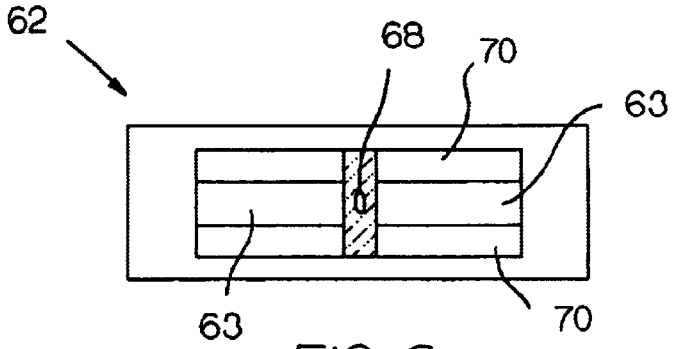

FIG. 6*a* is a top view of an anvil for use with the ultrasonic splicing device of FIG. 5.

Figure 6C:
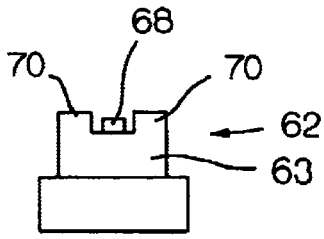
Figure 6B:
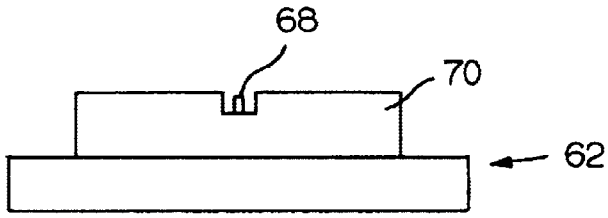

FIG. 6*b* is a side view of the anvil of FIG. 6*a*.

FIG. 6*c* is an end view of the anvil of FIG. 6*a*.

Figure 7A:
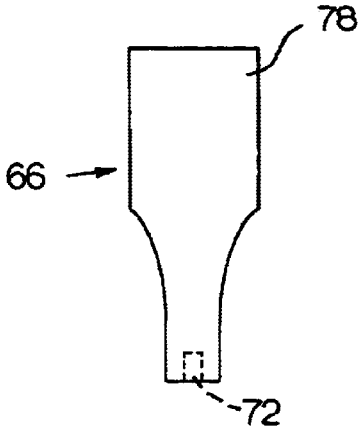

FIG. 7*a* is a front view of a horn, which is secured to one end of a hand piece of the ultrasonic splicing device of FIG. 5.

Figure 7B:
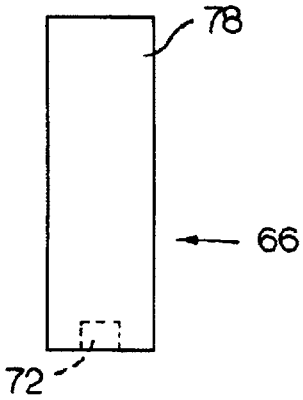

FIG. 7*b* is a side view of the horn of FIG. 7*a*.

Figure 7C:
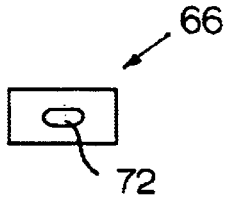

FIG. 7*c* is an end view of the horn of FIG. 7*a*.

DETAILED DESCRIPTION OF THE PREFERRED EMBODIMENT

The invention includes processes for splicing the cut ends of a continuous strip of packets or bags used to hold bulk material and devices useful for those processes. Bulk materials, such as desiccants, odor absorbers, oxygen absorbers, and the like are often packaged in individual packets, bags, or canisters. These packets or bags are often produced from a continuous strip of packaging material. For example, continuous strips of desiccant packets, having a fill weight ranging from as little as 0.125 grams to 10 grams or more, are prepared for use in a variety of applications, such as pharmaceutical, nutritional, diagnostic and storage. These packets are formed from a continuous packaging material which allows air to flow through the packet, for example, GDT-2, GDT-3, and GDT-4 manufactured by San-Ai Ltd. or TYVEK®, manufactured by DuPont. These packets or bags are formed using a conventional form-fill-and-seal machine. These machines form these packets by sealing the packaging material to itself, introducing bulk material into the individual packets and sealing the open end of the packets together. Different technologies have been used to seal the ends of the packets depending on the type, composition and use of the fill material. For example in one embodiment pressure and heat are applied to the material by means of heated seal bars to seal the packaging material and form the packets. Alternatively, an impulse sealer or ultrasonic heating element may be used to form the seals of these packets.

Figure 1:
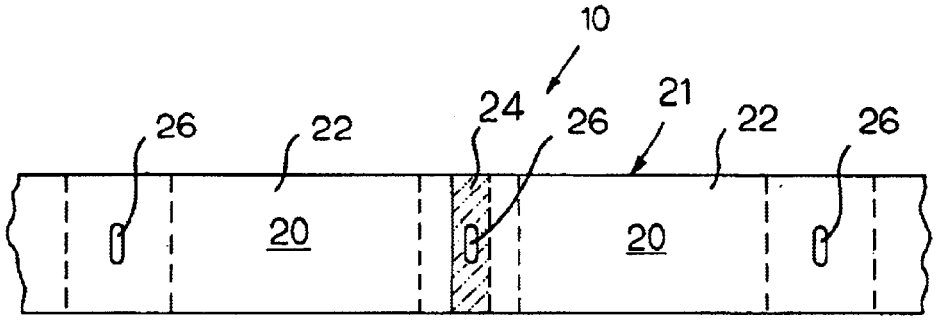
FIG. 1 is a top view of a continuous strip of packets containing bulk material.
Figure 2:
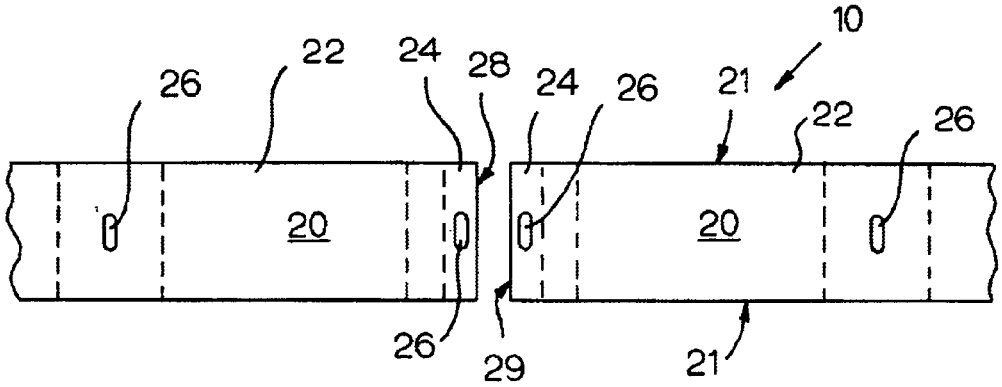
FIG. 2 is a top view of the continuous strip of packets of FIG. 1 cut into two sections, each section ending with a sealed area.
Figure 3:
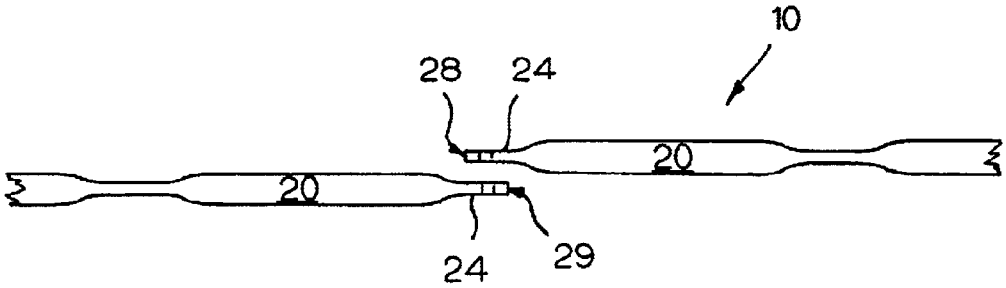
FIG. 3 is a side view of the two sections of the continuous strip of packets of FIG. 2 with the sealed area at the end of one section placed directly above the sealed area at the end of the other section.

In the process of use of the form-fill-and-seal machine, a continuous strip (10) of the individual packets as shown, for example in FIGS. 1, 2 and 3 is formed. The continuous strip (10) is comprised of individual packets (20), each of which consists of that portion of the packet (20) which holds the bulk material (22) and sealed areas (24) at the ends of the packets (20) which exist between the individual packets (20) holding the bulk material. Placed approximately in the center of each sealed area (24) is preferably an opening (26). To insure a reliable cutting and dispensing process, the dispensing machine for the continuous strip (10) of packets utilizes a sensor to sense this opening (26) in the individual packets (20) and to cut the continuous strip (10) through this opening (26) to form the individual packets. The sensor utilized with the continuous strip (10) is a light sensor which senses the openings (26) in the sealed area (24).

During the manufacture of the packets (20), it is often necessary that the form-fill-and-seal machine must be stopped during a production run due to mechanical or electrical problems, scheduled maintenance, feed problems, fill weight adjustments and the like. In addition, individual packets must periodically be sampled to check for quality. To sample the packets the continuous strip (10) is cut during these stoppages to remove an individual packet (20). While these stops do not affect the production of the packets (20) as a whole, they do result in the production of cut ends (28, 29) of the continuous strip (10) as shown in FIGS. 2 and 3. In order to assure the specified minimum number of packets (20) in the continuous strip (10), the cut ends (28, 29) of the continuous strip (10) must be spliced together. The conventional preferred method for splicing cut ends (28, 29) of a continuous strip (10) together is by placing a piece of colored adhesive tape over both cut ends (28, 29). This tape method creates various problems, including the tape not being as strong as the original uncut strip, the tape must be removed prior to utilization of the individual packet (20) to which the tape has been attached, the taped packet is not as visually appealing to the consumer and the tape cannot be utilized with certain pharmaceutical products because of fear of contamination of the pharmaceutical products by the tape.

Figure 4:
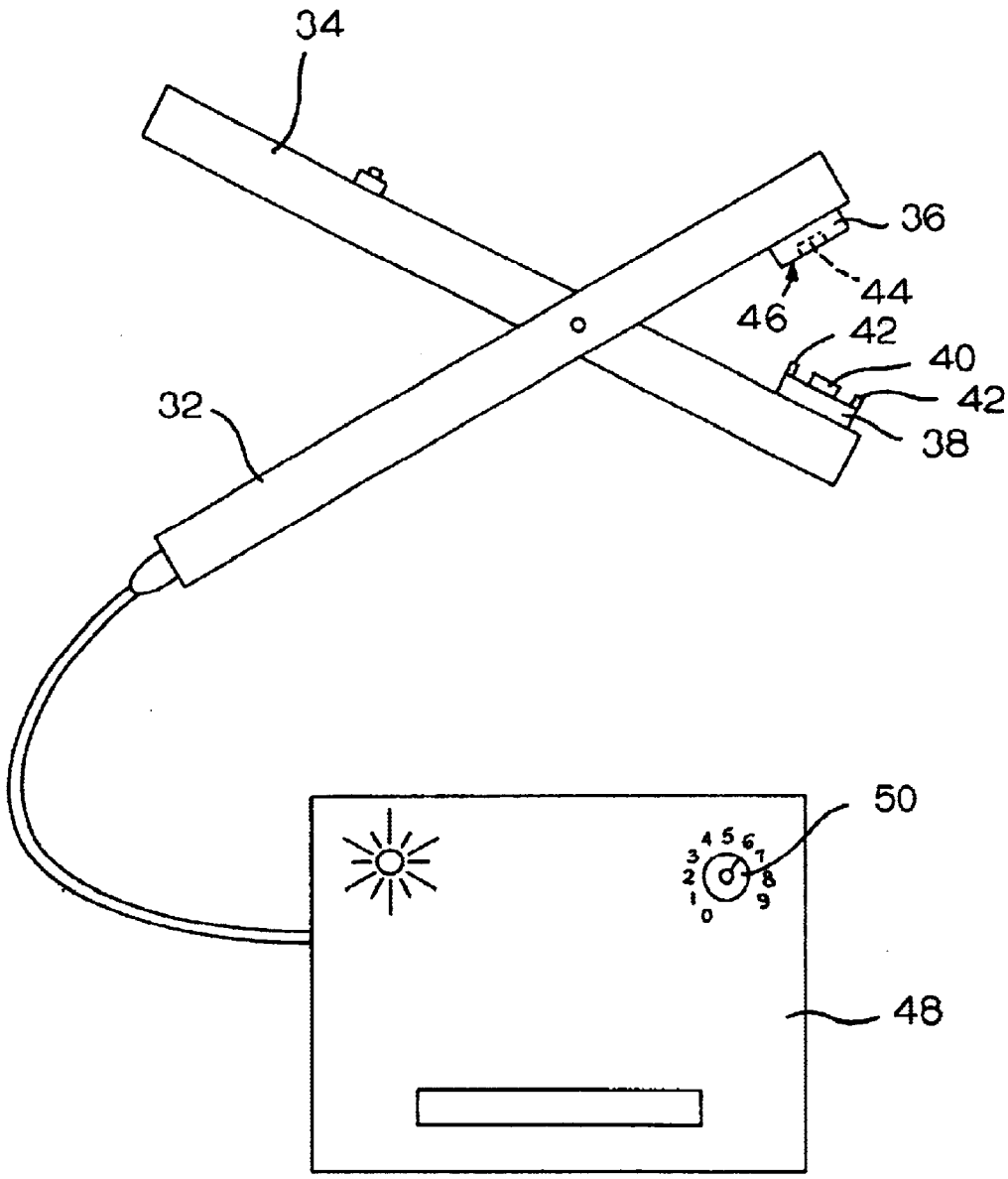
FIG. 4 is an impulse splicing device for splicing the sealed areas of two cut end sections of a continuous strip of packets.

Accordingly, the invention is a group of processes for splicing the cut ends (28, 29) of a continuous strip (10) of packets or bags used to hold bulk material which replaces the conventional adhesive tape method for sealing of these cut ends (28, 29) of the continuous strip (10). In one preferred embodiment, the process used to seal the cut ends (28, 29) of the continuous strip (10) utilizes an impulse splicing machine as shown in FIG. 4. The process for splicing the cut ends (28, 29) of a continuous strip (10) of packets or bags (20) used to hold bulk material utilizing an impulse splicing mechanism begins with the formation of the continuous strip of packets or bags from packaging material, filling those packets or bags with the bulk material and sealing the ends of the packaging material to form the continuous strip (10) of individual packets (20) as shown in FIG. 1. The continuous strip (10) is then cut at least twice across the sealed area (24) at a location chosen so that each exposed end (28, 29) of the continuous strip (10) includes a hole (26) in a sealed area (24). This cut results in the loss of at least one of the individual packets and creates two ends (28, 29), each containing a sealed area (24), as shown in FIG. 2. The respective sealed areas (24) of the two ends (28, 29) are placed one on top of the other with the holes (26) in the respective sealed areas (24) being aligned above each other, as shown in FIG. 3.

The impulse splicing machine (30) as shown in FIG. 4 consists of a pair of arms (32, 34) joined together in such a manner as to permit the rotation of one arm (32) in relation to the other arm (34) and a power supply (48) secured by wire to one of the arms (32) of the impulse splicing machine (30). At the ends of each of the arms (32, 34) are secured the elements of the impulse splicing machine (30) which are useful for splicing the ends of the continuous strip (10). At the end of one of the arms (32) is secured an upper base (36).

A lower base (38) is secured at the end of the other arm (34). These upper and lower bases (36, 38) receive and hold the sealed areas (24) of the continuous strip (10) during splicing.

The lower base (38) includes a pin (40) over which the holes (26) in the sealed area (24) of the ends (28, 29) of the continuous strip (10) are placed. The lower base (38) also contains raised guide sides (42) which guide the side edges (21) of the continuous strip (10) and hold them in place so that the sealed areas (24) of the continuous strip (10) can be properly aligned and then sealed. The upper base (36) contains a complimentary opening (44) in an upper surface (46) of the upper base (36), which opening (44) fits over the pin (40) in the lower base (38). When in use the upper base (36) is pressed against the lower base (38) and energy is applied to heat the two sealed areas (24) and form the seal between the two portions of the continuous strip (10). Of course, the components of the upper base (36) can also be secured to the lower base (38) and the components of the lower base (38) can be secured to the upper base (36).

In use the continuous strip (10) is cut to the design specifications as shown in FIG. 2 such that each of the ends (28, 29) of the sealed areas (24) of the continuous strip (10) contain an opening (26) as shown in FIG. 2. Each of these ends (28, 29) is then placed in the position that is shown in FIG. 3. Each of these ends (28, 29) is then placed over the pin (40) in the lower base (38). The guide sides (42) in the lower base (38) hold the ends (28, 29) and sides (21) of the continuous strip (10) in proper position for splicing. The upper base (36) is then rotated downward such that it is pressed firmly against the lower base (38) holding the two ends (28, 29) of the continuous strip (10) securely in a proper position for splicing. An activator (50) then activates the power from the power supply (48) and directs it to the upper and lower bases (36, 38). The amount of energy utilized is sufficient to heat and melt the sealed areas (24) together and form a strong seal between the individual ends (28, 29) of the continuous strip (10). The energy from the activator (48) is adjusted so that a sufficiently hot temperature is reached between the upper base (36) and the lower base (38) such that the two ends (28, 29) of the continuous strip melt together and form a strong seal. The seal that is formed is then allowed to cool in place so that the spliced seal properly cures before the upper base (36) is rotated away from the lower base (38) of the impulse splicing machine (30). The seal that is formed is then inspected for appearance and strength and the continuous strip (10) is then returned to normal operation.

Another process of the invention utilizes ultrasonic splicing equipment (60) as shown in FIGS. 5, 6*a*, 6*b*, 6*c*, 7*a*, 7*b* and 7*c*. The ultrasonic splicing equipment (60) of FIG. 5 is comprised of an anvil element (62) (see FIGS. 6*a*, 6*b* and 6*c*), a hand piece (64) with horn (66) (see FIGS. 7*a*, 7*b* and 7*c*) and a power supply (76), which is attached by an extended wire to the hand piece (64) as shown in FIG. 5.

When using this ultrasonic splicing equipment (60), the continuous strip (10) is cut into two pieces as shown in FIG. 2. The ends (28, 29) of the sealed areas (24) are then placed in the position as shown in FIG. 3. The openings (26) in the sealed areas (24) are then placed in the anvil element (62) of FIGS. 6*a*, 6*b* and 6*c*. The anvil (62) consists of a base (63) to which is secured a pin (68) and a pair of guide sides (70) to receive the cut ends (28, 29) of the continuous strip (10). The distance between the guide sides (70) of the anvil (62) is sufficient to hold the two sections of the continuous strip (10) in proper position for splicing. The holes in the sealed areas (24) are placed over the pin (68) in the anvil (62) with the sides (21) of the continuous strip (10) placed against the base (63) between the guide sides (70) of the anvil (62).

The hand piece (64) (FIG. 5) with horn (66) as shown in FIGS. 7*a*, 7*b* and 7*c* is then brought into contact with the anvil (62). The horn (66) includes a resonator (78) and an opening (72) in the end of the horn (66) which is slightly larger than the pin (68) in the anvil (62). After the hand piece (64) with horn (66) is placed over the pin (68) in the anvil (62), ultrasonic energy is supplied from the power supply (76) upon activation by the activator (74). The activator (74) remains activated until sufficient ultrasonic splicing energy has been conveyed to the two ends (28, 29) of the sealed area (24) of the continuous strip (10) to melt those two ends together and form a good seal between the two sealed areas (24) of the continuous strip (10). The spliced continuous strip (10) is then removed from the anvil element (62) and visually and physically inspected for appearance and strength.

Other processes may also be used to splice the two ends (28, 29) of the continuous strip (10). For example, an adhesive material may be placed between the sealed areas (24) of the two ends (28, 29) of the continuous strip (10) after they have been placed in the position as shown in FIG. 3. The types of acceptable adhesive material are well known in the art. The two portions of the continuous strip (10) are then held securely together by conventional means until the adhesive seal is secure.

Any other process which results in the formation of a strong seal between the two sealed areas (24) of the ends (28, 29) of the continuous strip (10) is within the scope of the invention.

Although the invention has been described in detail, it is clearly understood that the description contained in the specification is in no way to be taken as a limitation on the scope of the invention. The scope of the present invention can only be limited by the appended claims.

What is claimed is:

1. A process for splicing cut ends of a continuous strip of packets used to hold bulk material comprising forming a continuous strip of packets from packaging material and filling the packets with bulk material, sealing edges of the packaging material to form individual packets of the continuous strip, wherein adjacent packets share a common sealed area of packaging material, forming openings in the common sealed areas between adjacent packets, cutting the continuous strip entirely across the common sealed area of the packets at two separate locations on the continuous strip to form cut ends, wherein each of the cut ends of the continuous strip contains one of the openings in the common sealed area, and without using splicing tape, splicing together the two cut ends of the continuous strip with openings such that the openings overlap.

2. The process of claim 1 wherein the two cut ends of the continuous strip are spliced together by ultrasonic welding.

3. The process of claim 2 wherein the ultrasonic welding is accomplished by a device comprising an anvil comprising a base to which is secured a pin and guiding sides and an ultrasonic energy generator element comprising a hand piece, a horn and a power supply, wherein the horn is secured to one end of the hand piece, and wherein the horn comprises a resonator element and an opening at one end of the horn.

4. The process of claim 1 wherein the two cut ends of the continuous strip are spliced together by heating the sealed areas of the cut ends of the continuous strip to melt or partially melt the cut ends of the continuous strip together.

5. The process of claim 4 wherein the heating step uses impulse heating.

6. The process of claim 5 wherein the impulse heating is accomplished by an impulse heating machine comprising a pair of arms joined together, each containing a base, wherein one of the bases comprises a lower surface element containing a pin and guiding sides and the other base comprises an upper surface and an opening in the upper surface complimentary with the pin of the lower surface and a source of energy transmitted to the bases.

7. The process of claim 1 wherein the two ends of the continuous strip are spliced together by use of an adhesive material.

* * * * *